US006233937B1

(12) United States Patent
Gray

(10) Patent No.: US 6,233,937 B1
(45) Date of Patent: May 22, 2001

(54) COOLING SPRAY APPLICATION TO A TURBINE AND EXHAUST REGION OF A STEAM TURBINE

(75) Inventor: Lewis Gray, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/666,685

(22) Filed: Sep. 20, 2000

(51) Int. Cl.[7] ..... F01K 13/02; F04D 31/00

(52) U.S. Cl. ..... 60/646; 60/657; 415/116; 415/117

(58) Field of Search ..... 60/650, 657, 646; 415/116, 117, 177, 180

(56) References Cited

U.S. PATENT DOCUMENTS

| | | | | |
|---|---|---|---|---|
| 3,306,575 | | 2/1967 | Frankel et al. . | |
| 4,419,044 | * | 12/1983 | Barry et al. | 415/117 |
| 4,512,715 | | 4/1985 | Cohn et al. . | |
| 4,907,945 | | 3/1990 | Schoenwald . | |
| 5,653,577 | | 8/1997 | Wuhrer . | |
| 5,697,209 | | 12/1997 | Wettstein . | |
| 5,944,483 | | 8/1999 | Beck et al. . | |
| 5,983,623 | * | 11/1999 | Aoki et al. | 415/117 X |
| 6,065,282 | * | 5/2000 | Fukue et al. | 415/117 X |
| 6,126,389 | * | 10/2000 | Burdgick | 415/117 X |

* cited by examiner

*Primary Examiner*—Hoang Nguyen

(57) ABSTRACT

A dual-fluid cooling spray device for use with a steam turbine. The steam turbine includes a casing, a plurality of rotating blades and a plurality of stationary vanes. The dual fluid spray device includes a nozzle adjacent to one row of rotating blades and/or stationary vanes, and a dual fluid housing assembly penetrating the casing and coupled to the nozzle. Both a steam pipe and a water pipe are coupled to the dual-fluid housing assembly.

32 Claims, 4 Drawing Sheets

COOLING SPRAY APPLICATION TO A TURBINE AND EXHAUST REGION OF A STEAM TURBINE

BACKGROUND OF THE INVENTION

1. Field of the Invention

This invention relates to a device for cooling the last rows of rotating blades and stationary vanes of a steam turbine and, more specifically, to a device that combines water and steam to deliver a dual-fluid having a fine droplet size to the last rows of rotating blades and stationary vanes of a steam turbine.

2. Background Information

Steam turbines are well known in the prior art. Such turbines include a casing which houses rows of stationary vanes and rotating blades. Compressed working steam expands while passing through the vanes and blades, causing the blades to rotate. The blades cause a shaft, which is coupled to a generator, to rotate, thus allowing power to be generated.

With advances in steam turbine design, turbine blades now have large enough diameters and rotate at a sufficient speed that windage heating during a shut down of the turbine creates temperatures which approach the operating limits of the blades and vanes. Particularly during shut down of the turbine, the normal flow of working steam is effectively terminated by closure of the valves admitting steam into the turbine. Any fluid, e.g., residual steam in the turbine, tends to remain within the turbine and/or the exhaust region. That is, any fluid within the turbine and/or the exhaust region does not move significantly upstream or downstream from the turbine and/or the exhaust region. These conditions are characterized by a strong recirculation and a backflow from the exhaust region through the last stage of the turbine. As the blades rotate at high speeds, e.g., near normal operating r.p.m., the recirculating fluid which is trapped in the exhaust region is heated due to friction. Heat from the fluid is transferred to the blades and vanes. Such heating can cause the blade and vane temperature to rise to above 600° F. Allowing the blades to reach these temperatures reduces the margin between material strength (which is temperature dependent) and operating stresses (which are speed dependent). During a start-up of the turbine, the flow through the turbine is reduced to about 3 to 5% of normal flow. Under these conditions, windage heating and recirculation occurs, but is not as severe.

To maintain the margin between strength and stress limits of the blades, cooling devices are used to reduce the temperature within the turbine and/or the exhaust region during start-up and shutdown sequences. Prior art cooling devices for steam turbines include mechanisms which inject water droplets into the flow path. These water droplets typically have a Sauter mean droplet size of 300–400 microns. One disadvantage of such devices is that the larger droplets require a disproportionately long time to complete the evaporation process, thus reducing cooling effectiveness. A second disadvantage is that the larger water droplets cause erosion damage over time as the droplets impact on the rotating blades.

Therefore, there is a need for a cooling device for the exhaust region of a steam turbine that produces a very fine cooling spray that will provide effective evaporative cooling but which will not cause erosion damage to the rotating blades.

There is a further need for a cooling device that is adaptable for use with existing steam turbines.

SUMMARY OF THE INVENTION

These needs and others are met by the present invention which provides a cooling device which uses a dual-fluid cooling spray. The cooling device includes a nozzle in the exhaust region of a steam turbine. The nozzle is coupled to both a water source and a steam source. By combining the water and steam into a dual-fluid spray, micro-droplets having a Sauter mean droplet size of 30 microns can be produced.

The dual-fluid cooling device includes at least one of nozzle located within a turbine's casing and positioned upstream of the last stationary vane, or after the last rotating blade. The nozzle may be located after the last rotating blade as recirculation of the exhaust flow will draw the dual-fluid into the blade path.

The cooling device is structured to create micro-droplets having a Sauter mean droplet size of 30 microns and which are, typically, between 1 and 150 microns in diameter. The cooling device creates such fine sized droplets by mixing water supplied at about 110 p.s.i, and dry steam at a minimum temperature about 50–100° F. above the saturation temperature at about 110 p.s.i. absolute. The mixing of the water and steam occurs external to the nozzle exit plane, that is, the dual fluid is mixed immediately as the steam and water exit the nozzle. This produces a dual fluid spray having a droplet size between 1 micron and 150 microns. The dual fluid spray is ejected from a nozzle at a pressure of about 0.5 p.s.i.a. to 5 p.s.i.a, corresponding to the turbine exhaust pressure. The temperature of the mixed-out dual fluid spray will be at or above the saturation temperature depending on the dispersion of the spray and the temperature of the surrounding fluid. Micro-droplets evaporate more rapidly than the droplets of the prior art and produce a greater cooling effect. Micro-droplets are not large enough to cause significant erosion of the blades.

In another embodiment, a plurality of nozzles are provided within a turbine's casing and positioned upstream of the last stationary vane, or after the last rotating blade. The plurality of nozzles preferably includes eight nozzles approximately evenly spaced around the casing.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE PREFERRED EMBODIMENT

Figure 1:
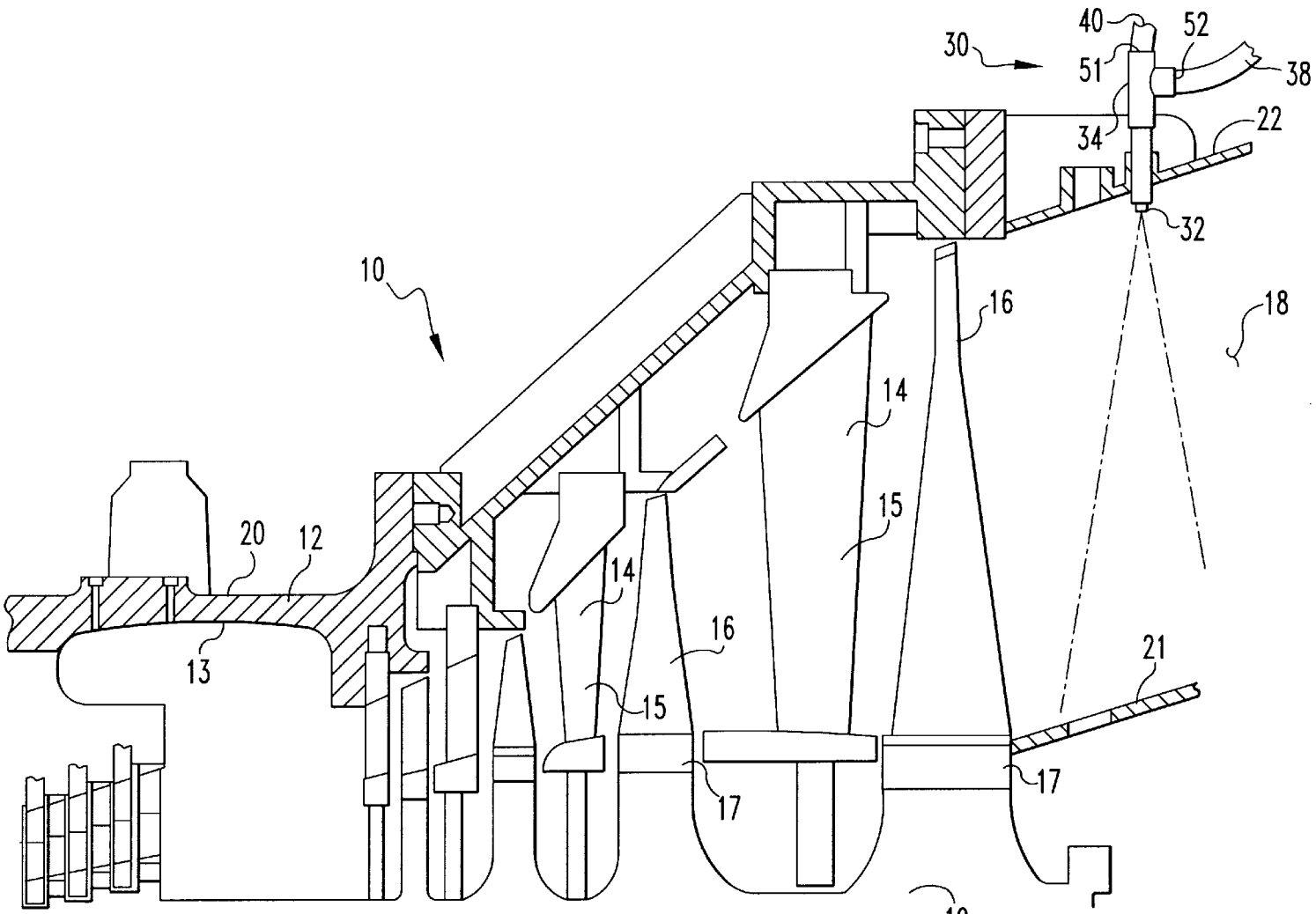
FIG. 1 is a cross-sectional partial view of a turbine incorporating a cooling device.

A steam turbine 10 which includes a cooling device 30 according to the present invention is shown in FIG. 1. The turbine includes an elongated casing 12 having an inner side 13, a plurality of stationary vanes 14 disposed within a plane, or row 15, a plurality of rotating blades 16 disposed within a plane, or row 17. The rows of vanes 15 are attached to the casing 12 and the rows of blades 17 are attached to a central shaft 19 that extends along the longitudinal axis of the casing 12. The turbine also includes an annular channel 18 that is generally bounded by casing 12 on the outside and a casing 21 on the inside defining an exhaust flow path for the working steam. The channel 18 has a flow direction beginning with a narrow, upstream side 20 and ending with a wider downstream side 22. A turbine 10 may have more than one row of vanes 15 and blades 17. Groups of vanes and blades are referred to as a stage, i.e. the first row of vanes 15 plus the first row of blades 17 is the first stage of the turbine 10.

To reduce the affects of windage heating, at least one cooling spray device 30 is supported by the casing 12 and is disposed proximal to the rows of vanes or blades 15, 17. The cooling spray device 30 includes at least one nozzle 32, at least one dual-fluid housing assembly 34, a steam pipe 38 and a water pipe 40. The nozzle 32 is in fluid communication with the nozzle housing assembly 34. The housing assembly 34 penetrates casing 12 and is in fluid communication with the nozzle 32.

Figure 2:
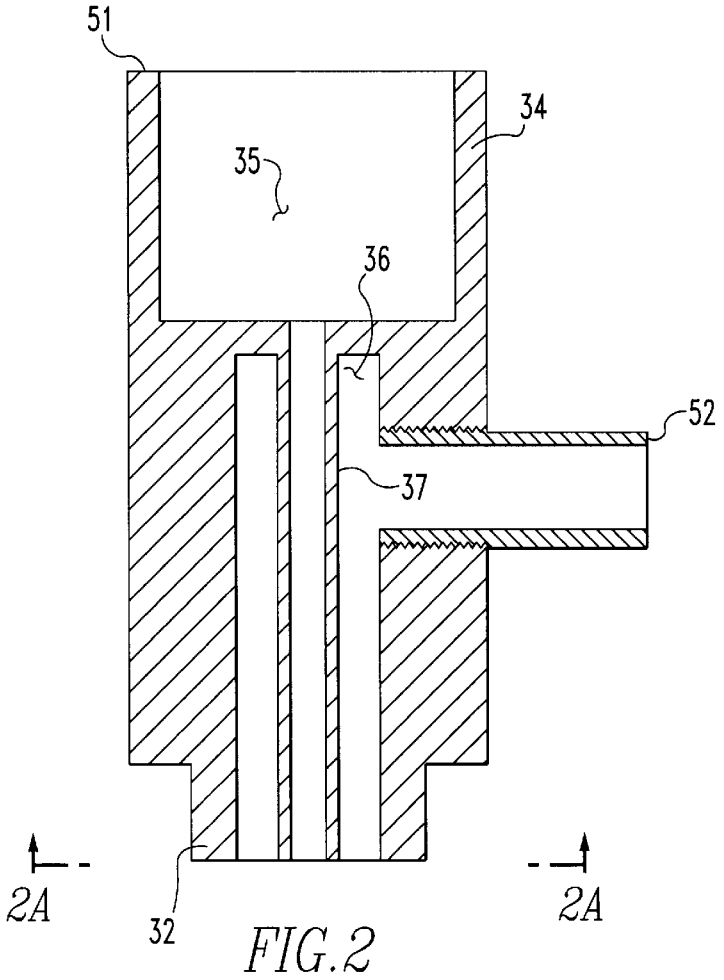
FIG. 2 is a cross-sectional view of a nozzle according to the present invention.
Figure 2A:
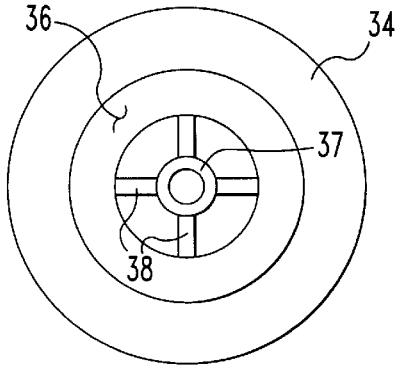
FIG. 2A is a bottom view of the nozzle taken along line A—A in FIG. 2.

Nozzle housing assembly 34 has two-inlet ports, a first, water inlet port 51 and a second, steam inlet port 52. The water inlet port 51 is in fluid communication with a water pipe 40. The steam inlet port 52 is in fluid communication with a steam pipe 38. As shown in FIG. 2, the nozzle housing assembly 34 includes two chambers, a water chamber 35 and a steam chamber 36. Water chamber 35 is in fluid communication with water inlet port 51. Steam chamber 36 is in fluid communication with steam inlet port 52. A hollow member 37, which is in fluid communication with water chamber 35 and nozzle 32 extends, through steam chamber 36. Steam chamber 36 is also in fluid communication with nozzle 32. As shown in FIG. 2A, a plurality of support members 38 may brace hollow member 37.

Figure 3:
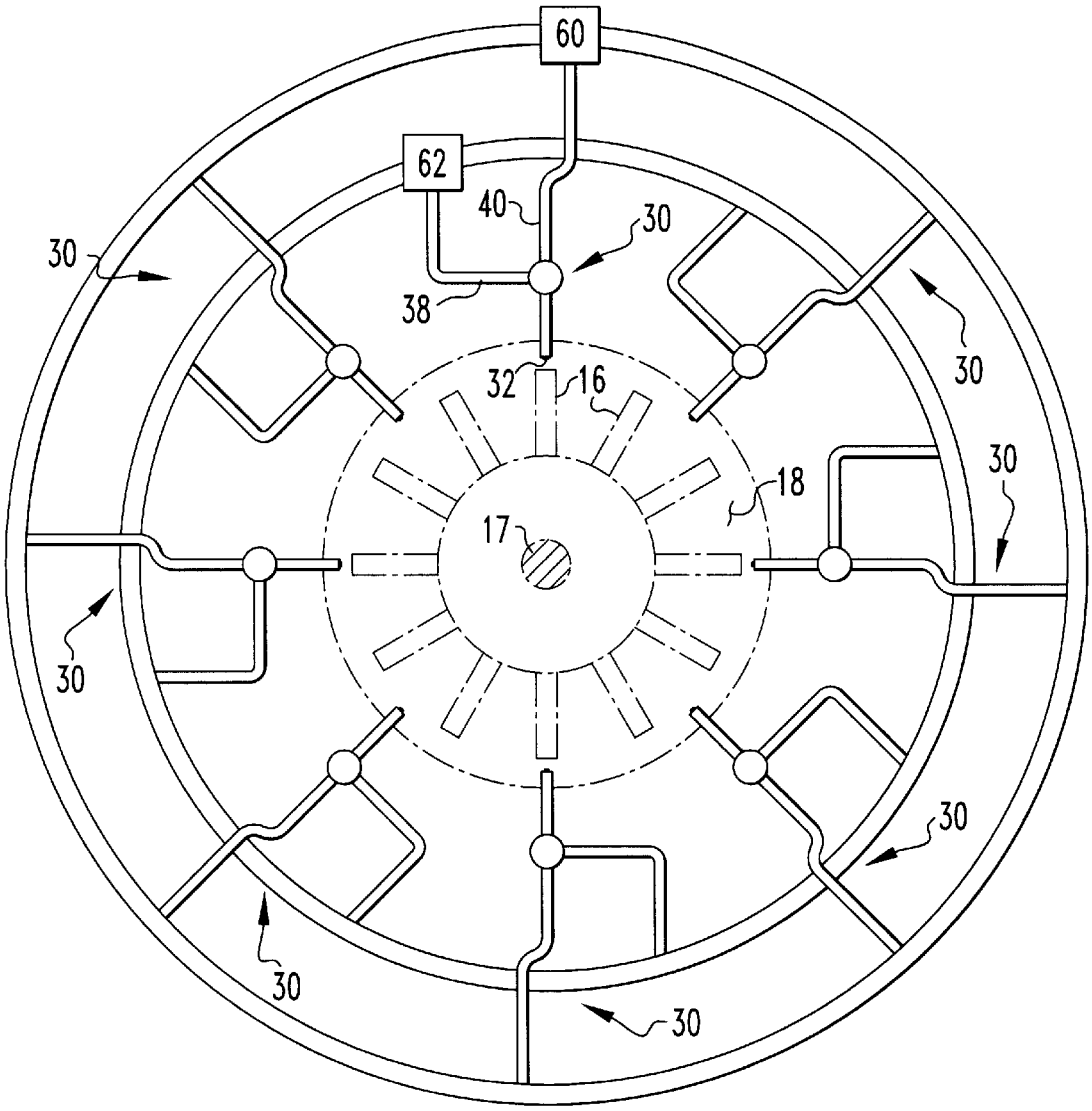
FIG. 3 is an axial view of a turbine incorporating a plurality of cooling devices.

As shown in FIG. 3, water pipe 40 is in fluid communication with a water source 60, such as a reservoir (not shown) or condensate pump discharge. Steam pipe 38 is in fluid communication with a steam source 62 such as a steam generator (not shown) or steam from a steam gland letdown station. In the nozzle housing assembly 34, the ratio of water to steam is 2 to 3 by weight. Water enters the housing assembly 34 at a temperature generally in the range from about 80° F. to 160° F. (27 to 71° C.), and more preferably at about 150° F. (66° C.). Water enters the housing assembly 34 at a pressure generally in the range from about 60 to 200 p.s.i.a.(4 to 14 bar), and, more preferably, about 110 p.s.i.a. (7.6 bar). Steam enters the nozzle housing assembly 34 at a minimum temperature about 50° F. to 100° F. (28 to 56° C.) above the saturation temperature, at about 60 to 300 p.s.i.a. (4 to 21 bar), and, more preferably, about 110 p.s.i.a. (7.6 bar). Typically, the steam will be at a temperature between about 400° F. (205° C.) and 740° F. (393° C.). When the steam is at about 110 p.s.i.a. (7.6 bar), the steam temperature is about 335° F. (168° C.).

The nozzle 32 is structured to provide a dual fluid spray having a droplet size between 1 micron and 150 microns, and, more preferably, having a Sauter mean droplet size of about 30 microns. The dual fluid water and steam components are ejected from the nozzle at pressures ranging from about 0.5 to 5.0 p.s.i.a. (0.03 to 0.35 bar). The temperature of the dual fluid spray is about near the saturation temperature which varies depending on the ejection pressure. The nozzle 32 may be structured to provide the dual fluid spay within about a 25° cone directed in a direction parallel to the rows of vanes 15 and rows of blades 17. At the preferred ejection pressure, the spray will should have sufficient momentum to reach the inner casing 21 opposite the nozzle 32.

Figure 4:
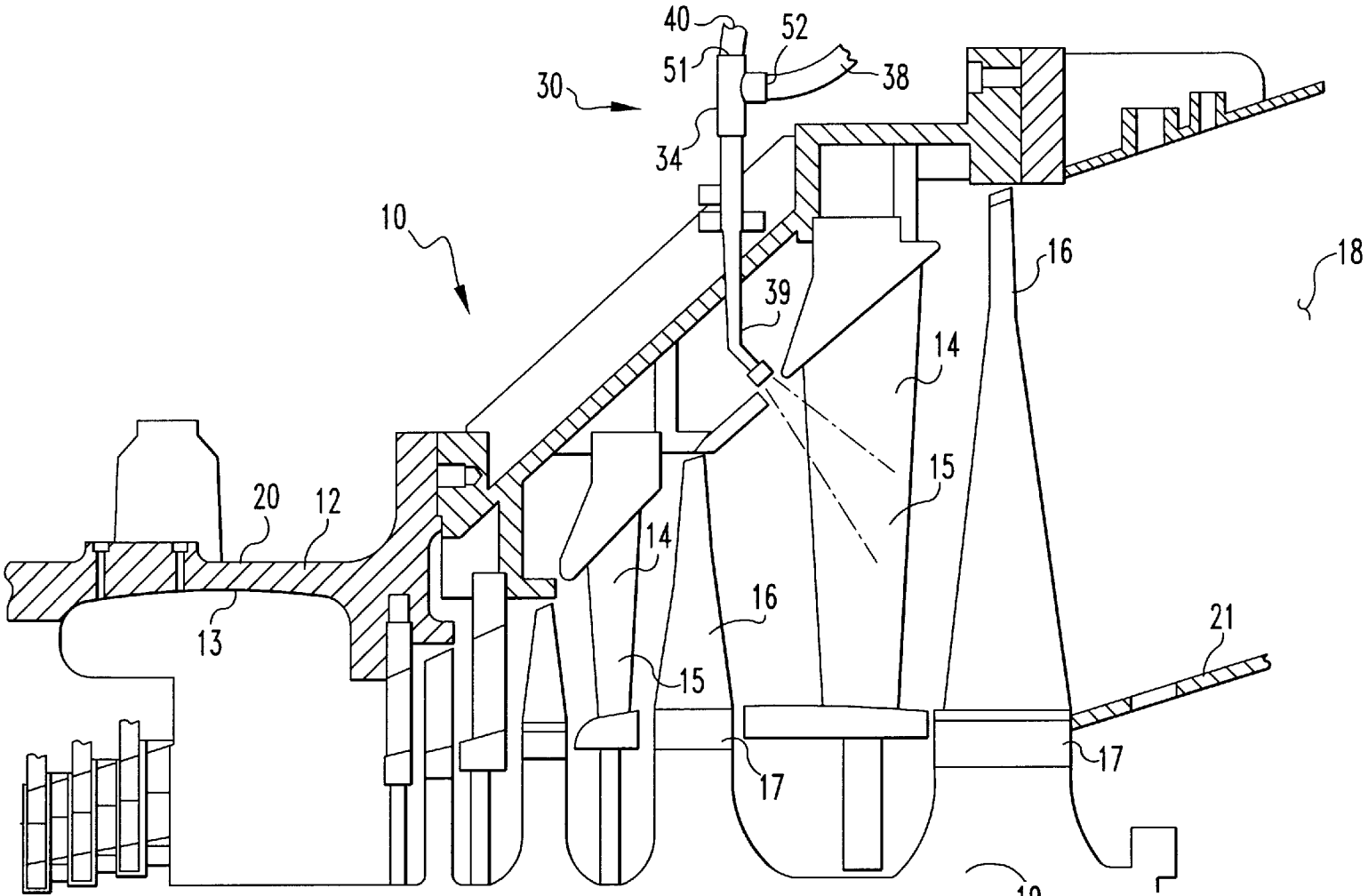
FIG. 4 is a cross-sectional partial view of another embodiment of the cooling device.

As shown in FIG. 1, the nozzle 32 may be mounted downstream of the last blade 16 and be either flush with or recessed behind the inner side 13 of casing 12. Alternatively, as shown in FIG. 4, the housing assembly 34 may include an elongated section 39 which spaces nozzle 32 away from casing inner side 13. Elongated Section 39 may be needed to direct the dual-fluid spray beyond internal structures integral to casing 12. Also, the nozzle 32 may be positioned as shown between the rows of vanes 15 and rows of blades 17.

As shown in FIG. 3, a plurality of cooling spray devices 30 may be spaced around casing 12 to eject the dual fluid spray evenly throughout channel 18. The optimal spacing of nozzles 32 may be determined by flow field analysis using computational fluid dynamic methods such as those employed by the programs Fluent, by Fluent Inc. or Tasc-Flow by AEA Technology Engineering Software Inc. Using nozzles 32 structured to provide a dual fluid spray in a 25° cone directed in a direction generally parallel to the rows of vanes 15 and rows of blades 17, it is preferred to have eight nozzles 32 generally within a plane and evenly spaced about the circumference of casing 12. The equal spacing between the nozzles 32 may be altered due to various structures either on or within the casing 12.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A dual-fluid cooling spray device for use with a steam turbine, said steam turbine including a casing, at least one row of rotating blades and at least one row of stationary vanes, said spray device comprising:

at least one nozzle proximal to said at least one row of rotating blades and said at least one row of stationary vanes;

a dual fluid housing assembly having a first inlet and a second inlet;

said housing assembly penetrating said casing and coupled to said nozzle;

a water pipe coupled to said dual-fluid housing assembly first inlet;

a steam pipe coupled to said dual-fluid housing assembly second inlet;

wherein a dual-fluid spray may be ejected proximal to said at least one row of rotating blades and said at least one row of stationary vanes.

2. The spray device of claim 1, wherein said dual fluid housing assembly includes a water chamber coupled to said nozzle and said water pipe, and a steam chamber coupled to said steam pipe.

3. The spray device of claim 2, wherein:

steam is introduced into said steam chamber through said steam pipe;

water is introduced into said water chamber through said water pipe; and said water and steam are at a ratio of 2 to 3 by weight.

4. The spray device of claim 2, wherein:

steam is introduced into said steam chamber through said steam pipe;

water is introduced into said water chamber through said water pipe; and said steam is maintained at a temperature between about 400° F. (205° C.) and 740° F. (393° C.).

5. The spray device of claim 4, wherein said steam is maintained between about 60 p.s.i.a. (4 bar) and 300 p.s.i.a. (21 bar).

6. The spray device of claim 2, wherein:

steam is introduced into said steam chamber through said steam pipe;

water is introduced into said water chamber through said water pipe; and said steam is maintained between about 60 p.s.i.a. (4 bar) and 300 p.s.i.a. (21 bar).

7. The spray device of claim 2, wherein:

water is introduced into said water chamber through said water pipe; and steam is introduced into said steam chamber through said steam pipe;

said steam is maintained at a temperature of about 50° F. to 100° F. (28 to 56° C.) above the saturation temperature, at about 60 to 300 p.s.i.a.(4 to 21 bar).

8. The spray device of claim 2, wherein:

steam is introduced into said steam chamber through said steam pipe;

water is introduced into said water chamber through said water pipe; and said water is maintained at a temperature between about 80° F. and 160 F.

9. The spray device of claim 8, wherein said water is maintained between about 60 p.s.i.a. (4 bar) and 200 p.s.i.a. (14 bar).

10. The spray device of claim 2, wherein:

steam is introduced into said steam chamber through said steam pipe;

water is introduced into said water chamber through said water pipe; and said water is maintained between about 60 p.s.i.a. (4 bar) and 200 p.s.i.a. (14 bar).

11. The spray device of claim 2, wherein:

water is introduced into said water chamber through said water pipe;

steam is introduced into said steam chamber through said steam pipe;

said water is maintained at a temperature of about 150° F. (66° C.) and 110 p.s.i.a. (7.6 bar).

12. The spray device of claim 11, wherein said steam is maintained at a temperature of about 50° F. to 100° F. (28 to 56° C.) above the saturation temperature and 110 p.s.i.a. (7.6 bar).

13. The spray device of claim 1, wherein said nozzle is disposed between said at least one row of blades and said at least one row of vanes.

14. The spray device of claim 1, wherein:

said steam turbine has a flow path and a flow direction; and said nozzle located downstream of said at least one row of rotating blades and said at least one row of vanes.

15. A steam turbine comprising:

a casing;

at least one row of rotating blades;

at least one row of stationary vanes;

at least one nozzle adjacent to said at least one row of rotating blades and said at least one row of stationary vanes;

at least one dual fluid inlet pipe assembly having a first inlet and a second inlet;

said at least one dual fluid inlet pipe assembly penetrating said casing and coupled to said nozzle;

a water pipe coupled to said dual-fluid inlet pipe assembly first inlet;

a steam pipe coupled to said dual-fluid inlet pipe assembly second inlet;

wherein a dual-fluid spray may be ejected proximal to said at least one row of rotating blades and said at least one row of stationary vanes.

16. The steam turbine of claim 15, wherein said dual fluid inlet pipe assembly includes a water chamber coupled to said nozzle and said water pipe, and a steam chamber coupled to said steam pipe.

17. The steam turbine of claim 16, wherein:

steam is introduced into said steam chamber through said steam pipe;

water is introduced into said water chamber through said water pipe; and said water and steam are at a ratio of 2 to 3 by weight.

18. The steam turbine of claim 16, wherein:

steam is introduced into said steam chamber through said steam pipe;

water is introduced into said water chamber through said water pipe; and said steam is maintained at a temperature between about 400° F. (205° C.) and 740° F. (393° C.).

19. The steam turbine of claim 18, wherein said steam is maintained between about 60 p.s.i.a. (4 bar) and 300 p.s.i.a. (21 bar).

20. The steam turbine of claim 16, wherein:

steam is introduced into said steam chamber through said steam pipe;

water is introduced into said water chamber through said water pipe; and said steam is maintained between about 60 p.s.i.a. (4 bar) and 300 p.s.i.a. (21 bar).

21. The steam turbine of claim 16, wherein:

steam is introduced into said steam chamber through said steam pipe;

water is introduced into said water chamber through said water pipe; and said steam is maintained at a temperature of about 50° F. to 100° F. (28 to 56° C.) above the saturation temperature, at about 60 to 300 p.s.i.a.(4 to 21 bar).

22. The steam turbine of claim 16, wherein:

steam is introduced into said steam chamber through said steam pipe;

water is introduced into said water chamber through said water pipe; and said water is maintained at a temperature between about 80° F. and 160F.

23. The steam turbine of claim 22, wherein said water is maintained between about 60 p.s.i.a. (4 bar) and 200 p.s.i.a. (14 bar).

24. The steam turbine of claim 16, wherein:

steam is introduced into said steam chamber through said steam pipe;

water is introduced into said water chamber through said water pipe; and said water is maintained between about 60 p.s.i.a. (4 bar) and 200 p.s.i.a. (14 bar).

25. The steam turbine of claim 16, wherein:

steam is introduced into said steam chamber through said steam pipe;

water is introduced into said water chamber through said water pipe; and said water is maintained at a temperature of about 150° F. (66° C.) and 110 p.s.i.a. (7.6 bar).

26. The steam turbine of claim 25, wherein said steam is maintained at a temperature of a temperature of about 50° F. to 100° F. (28 to 56° C.) above the saturation temperature and 110 p.s.i.a. (7.6 bar).

27. The steam turbine of claim 15, wherein said nozzle is disposed between said at least one row of blades and said at least one row of vanes.

28. The steam turbine of claim 15, wherein:

said steam turbine has a flow path and a flow direction; and said nozzle located downstream of said at least one row of rotating blades and said at least one row of vanes.

29. The steam turbine of claim 15, wherein a plurality of nozzles are disposed between said at least one row of blades and said at least one row of vanes.

30. The steam turbine of claim 29, wherein said nozzles are generally within a plane and evenly spaced about the circumference of said casing.

31. The steam turbine of claim 15, wherein:

said steam turbine has a flow path and a flow direction; and a plurality of nozzles are located downstream of said at least one row of rotating blades and said at least one row of vanes.

32. The steam turbine of claim 31, wherein said nozzles are generally within a plane evenly spaced about the circumference of said casing.

* * * * *